US005452756A

United States Patent [19]

Ohatake et al.

[11] Patent Number: 5,452,756

[45] Date of Patent: Sep. 26, 1995

[54] COOLING METHOD OF CONTINOUS CASTING

[75] Inventors: Norio Ohatake; Makoto Arase; Yoshitaka Nagai, all of Toyama, Japan

[73] Assignee: Yoshida Kogyo K.K., Tokyo, Japan

[21] Appl. No.: 171,347

[22] Filed: Dec. 21, 1993

Related U.S. Application Data

[63] Continuation of Ser. No. 940,986, Sep. 4, 1992, abandoned.

[30] Foreign Application Priority Data

Feb. 27, 1991 [EP] European Pat. Off. ..... 91102931
Sep. 19, 1991 [JP] Japan ..... 3-239501

[51] Int. Cl.[6] ..... B22D 11/124

[52] U.S. Cl. ..... 164/486; 164/444; 164/487

[58] Field of Search ..... 164/486, 487, 164/444

[56] References Cited

U.S. PATENT DOCUMENTS

| | | | |
|---|---|---|---|
| 2,515,284 | 7/1950 | Zeigler et al. | 164/487 |
| 3,124,855 | 3/1964 | Baier | 164/487 |
| 3,713,479 | 1/1973 | Bryson | 164/487 |
| 4,156,451 | 5/1979 | Getslev | 164/487 |
| 4,285,388 | 8/1981 | Sevastakis | 164/444 |
| 4,474,225 | 6/1984 | Yu | 164/487 |
| 4,567,936 | 2/1986 | Binczewski | 164/487 |
| 4,751,960 | 6/1988 | Naveau et al. | 164/444 |

FOREIGN PATENT DOCUMENTS

| | | |
|---|---|---|
| 255672 | 7/1967 | Austria . |
| 330387 | 6/1976 | Austria . |
| 0062606 | 3/1982 | European Pat. Off. . |
| 2909990 | 12/1979 | Germany . |

*Primary Examiner*—P. Austin Bradley
*Assistant Examiner*—Jeffrey T. Knapp
*Attorney, Agent, or Firm*—Hill, Steadman & Simpson

[57] ABSTRACT

A cooling mold having first and second water cooling jackets which are provided inside the mold, a primary cooling water jetting mouth which is located at a distance of 15 to 40 mm from a meniscus of the molten metal, and a secondary cooling water jetting mouth which is located at a position with an interval of 20 to 45 mm between a contact point of a primary jet of cooling water and another contact point of a secondary jet of cooling water on an ingot. By use of the cooling mold having the primary and secondary cooling water jetting mouths which are respectively set at an angle of 15 to 30 degrees and of 30 to 60 degrees relative to the ingot surface, the primary jet of cooling water from the primary mouth impinges on the molten metal cooled in the cooling mold at a short distance from the meniscus to establish a transition boiling zone and a film boiling zone, and then, the secondary jet of cooling water from the secondary mouth impinges on initial zones of the transition boiling zone and the film boiling zone to break-out a vapor film generated in the initial zones so as to provoke a nucleate boiling and thereby to produce a firmer solidified shell in the ingot, whereby the ingot can be properly and effectively cooled without danger of breakout so that stable high rate casting and a high quality ingot can be achieved.

5 Claims, 3 Drawing Sheets

COOLING METHOD OF CONTINOUS CASTING

This is a continuation of application Ser. No. 07/940,986, filed Sep. 4, 1992, now abandoned.

BACKGROUND OF THE INVENTION

1. Field of the Invention

This invention relates to a cooling method and a cooling mold for continuous casting of ingots from molten aluminum, aluminum alloys, or other metals. More particularly, the invention relates to a method of continuous and direct chill casting and a mold for carrying out the direct chill casting method.

2. Description of the Prior Art

In this continuous casting method as shown generally in FIG. 4, a molten metal 13 is injected from a tundish 11 through an orifice plate 15 into a mold 12 which is water-cooled so that the molten metal 13 is cooled in the mold 12 to cast an ingot 14. The molten metal 13 which is introduced through the orifice plate 15 to the mold 12 is contacted with a wall surface of the mold 12 to form a thin solidified shell and is further cooled and cast with impinging cooling water applied from the mold 12.

In the continuous casting, a higher rate of casting is desired to improve the production rate. In order to realize the higher rate of casting, it should be simultaneously required to promote the casting quality, such as the surface condition of the ingot, by proper cooling.

In the high rate casting, when the molten metal is solidified in the cooling mold to form the solid shell, the higher rate of casting requires a greater amount of heat extraction and thereby a larger amount of cooling water. The cooling water is applied from the mold to directly impinge on the high temperature ingot and cool it. However, when the casting rate is increased, since the surface temperature of the ingot becomes higher in a situation of impingement cooling with cooling water, a transition boiling zone and a film boiling zone are produced on the ingot surface, and a vapor film which creates an adiabatic phase between the ingot surface and the cooling water is formed thereon. Thus, even if the amount of cooling water is increased, the cooling water does not effectively function to carry out heat extraction so that the danger of break out increases, and problems such as causing quality defects of the ingot arise. Hence, these problems been the factors which have considerably reduced the casting stability and the quality stability.

In order to solve these problems, cooling methods have been proposed in which directly impinging cooling water is used in two steps as disclosed for example in JP,A Sho 58-212849 (Japanese Patent Laid-Open Application).

However, in the two-step cooling method using the cooling water as disclosed in the above Japanese Patent publication, since the distance between the first cooling zone and the second cooling zone becomes considerably long, that is one-half to two times the diameter of the ingot, the surface of the ingot which has been cooled in the first cooling zone is again heated by the time it reaches the second cooling zone due to heat flow from an internal region of the ingot. Hence, even when the second cooling is carried out, the transition boiling and film boiling phenomenona are again produced reducing cooling efficiency. When using high rate casting, this tendency is increased which considerably reduces the cooling efficiency.

SUMMARY OF THE INVENTION

It is, therefore, an object of this invention to provide a cooling method and a cooling mold for continuous casting of an ingot wherein even if the continuous casting rate is increased, a proper cooling can be carried out to prevent danger of breakout so as to provide a stable casting and a high quality ingot.

This invention relates to a cooling method for a continuous casting process in which an ingot is continuously withdrawn and cast from a cooling mold while cooling a molten metal in the mold. The cooling method of this invention comprises a primary direct chill step in which primary cooling water from the cooling mold impinges on the molten metal cooled in contact with the cooling mold at a short distance from the meniscus of the molten metal to establish a transition boiling zone and a film boiling zone, and a secondary direct chill step in which a secondary cooling water impinges on the initial zones of the transition boiling zone and the film boiling zone to break-out vapor film generated in the initial zones to provoke a nucleate boiling and thereby to produce a firmer solidified shell in the ingot without causing casting cracks, whereby the solidifying ingot is properly and effectively cooled to provide a stable high rate casting and a high quality ingot.

Preferably, the impinging angle of the primary cooling water impinging against an ingot surface is 15 to 30 degrees, and the impinging angle of the secondary cooling water impinging against the ingot surface is 30 to 60 degrees. When the ingot has a diameter of 6 to 9 inches, the primary impinging cooling water from the mold contacts the ingot at a distance L1 of 15 mm to 40 mm from a meniscus which is a starting point of development of solidifying a shell, and a distance L2 between the contact point of the primary impinging cooling water from the mold and the ingot and the other contact point of the secondary impinging cooling water and the ingot in the transition boiling zone and the film boiling zone wherein L2 is preferably 20 mm to 45 mm.

A cooling mold for accomplishing this cooling method comprises first and second water cooling jackets inside thereof, and a primary cooling water jetting mouth and a secondary cooling water jetting mouth which are disposed at a predetermined distance in the withdrawing direction of an ingot, wherein the primary cooling water jetting mount is set at an angle of 15 to 30 degrees relative to the ingot surface, and the secondary cooling water jetting mouth is set at an angle of 30 to 60 degrees relative to the ingot surface. The primary cooling water jetting mouth has preferably a whole peripheral slit shape, and the secondary cooling water jetting mouth has a grooved or holed shape.

This invention will be illustrated in detail with the operation.

Generally in a casting mold, when a cooling water impinges directly on a high temperature ingot to cool the ingot, vapor bubbles or vapor films are produced on the high temperature ingot so that the cooling water coming into contact with the ingot extracts heat from the ingot surface of high temperature.

However, even when the cooling water is impinged on a high temperature ingot of about 600° C. to promote a forced convection heat transfer, the transition boiling zone and the film boiling zone are produced immediately after the cooling water is contacted with the high temperature ingot so that they are coated with a vapor film preventing contact between the cooling water and the ingot surface. In order to prevent the coating of the vapor film, even if the amount of cooling water is increased to improve the cooling effects, there is a limit in this improvement of cooling effects. At the same time, even if the pressure of the cooling water is increased, there is also a limit in the improvement of the cooling efficiency.

On one hand, the length of an unsolidified portion of the ingot in the casting process depends on a highly precise correlation between the cooling water amount, the cooling location and the ingot surface temperature. The shorter the length of the unsolidified ingot portion is the less casting cracks occur, and the weaker the cooling is the longer the length of the unsolidified ingot portion will be so that the solid-liquid coexistence phase is extended increasing the danger of casting cracks.

In view of these phenomenona, this invention intends to produce a firm solidified shell by impinging cooling water in a transition boiling zone and a film boiling zone, to break out a continuous vapor film produced thereon using the pressure of the cooling water, and to cool the ingot surface with direct cooling water to generate a nucleate boiling so as to provide an efficient cooling without compensating for the reduction of the cooling efficiency in the transition boiling zone and the film boiling zone which are produced on a high temperature surface of the ingot by increasing the amount and pressure of the cooling water.

In a casting of an ingot having a larger diameter of 6 to 9 inches, the contacting point of the primary impinging cooling water and a high temperature ingot is situated at a distance L1 of preferably 15 to 40 mm from a meniscus. When the distance L1 is less than 15 mm, the danger of generating the breakout in the start of the casting and the danger of generating breakout due to slight changes of casting conditions during casting are increased. When the distance L1 exceeds 40 mm, the direct cooling with the cooling water is retarded causing surface defects, such as bleeding out and external cracks, of the ingot surface. The depth of an inverse segregation layer becomes excessive to generate quality defects.

It is also favorable to set a distance L2 of 20 to 45 mm between the contacting point of the primary cooling water with the ingot and the other contacting point of the secondary cooling water with the ingot. When the distance L2 exceeds 45 mm, the cooling is retarded increasing the unsolidified length within the ingot which increases the danger of cast cracks.

The cooling water impinging angle relative to the ingot surface is one of the important factors in the efficient casting. It is favorable to set the primary cooling water impinging angle at 15 to 30 degrees and a secondary cooling water impinging angle at 30 to 60 degrees. When the primary cooling water impinging angle is set at less than 15 degrees, the distance from the meniscus which is a starting point of development of solidifying a shell is increased causing the bleeding out, and when it is set at more than 30 degrees, the cooling water flows inversely at the start of the casting which causes the breakout. It is required to set the secondary cooling water impinging angle at 30 to 60 degrees so as to break out the vapor film which is generated in the transition boiling zone and the film boiling zone by the primary cooling water.

With respect to the shape of a cooling water jetting mouth which is formed in a cooling mold, the whole periphery of the mold is provided with a slit, groove, or hole type opening. The primary cooling water jetting mouth adapts the slit-shaped opening on the whole inner circumferential surface of the mold to cool uniformly the whole outer periphery of the ingot. The secondary cooling water jetting mouth adapts the grooved or holed opening on the whole periphery of the mold to break out the vapor film which is produced in the transition boiling zone and the film boiling zone.

Further features and advantages of the present invention will be apparent from the detailed description below, and from the accompanying drawings.

DETAILED DESCRIPTION OF THE PRESENTLY PREFERRED EMBODIMENTS

Figure 1:
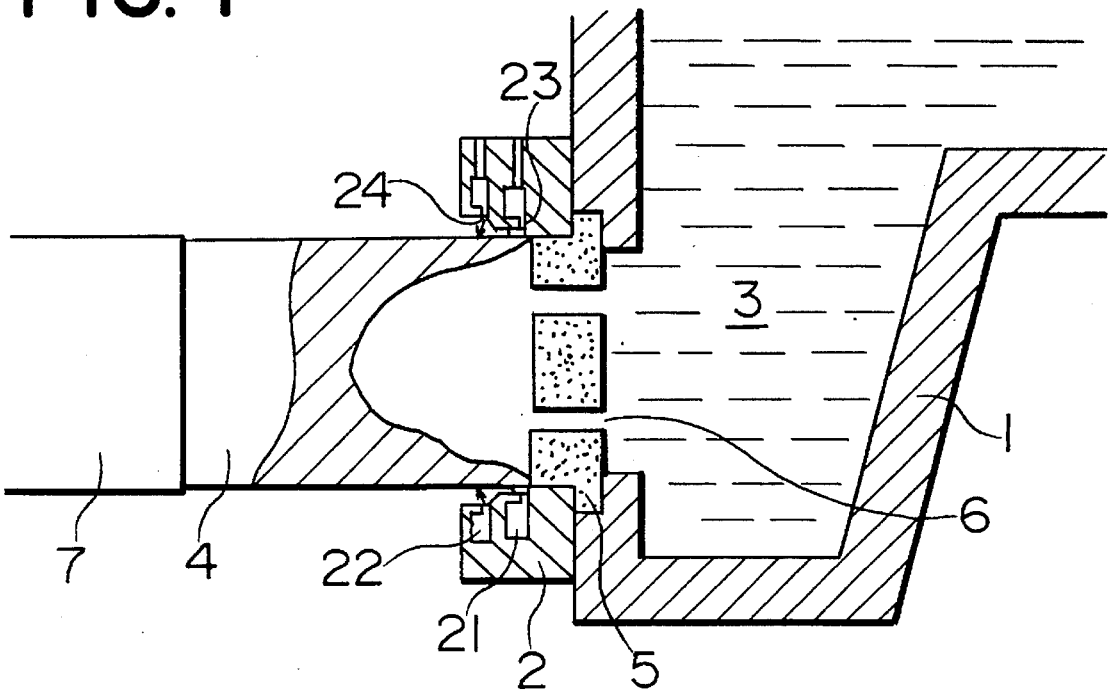
FIG. 1 is a longitudinal sectional view of the main part which shows a cooling state of a continuous casting process according to this invention.
Figure 2:
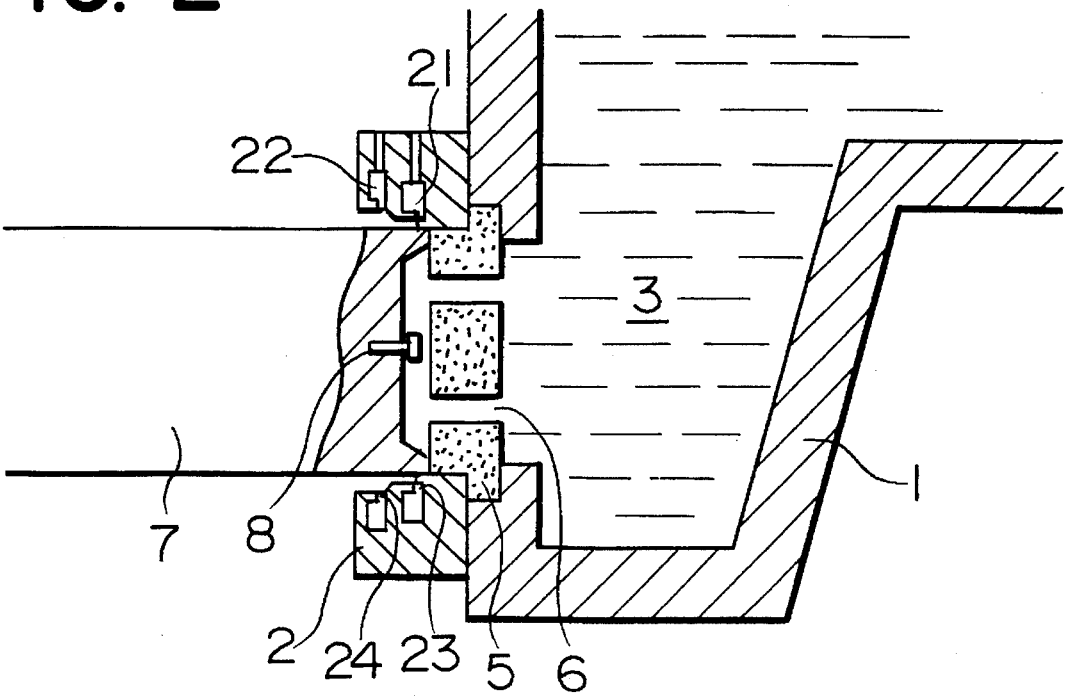
FIG. 2 is a longitudinal sectional view of the main part which shows a starting state of the casting process.
Figure 3:
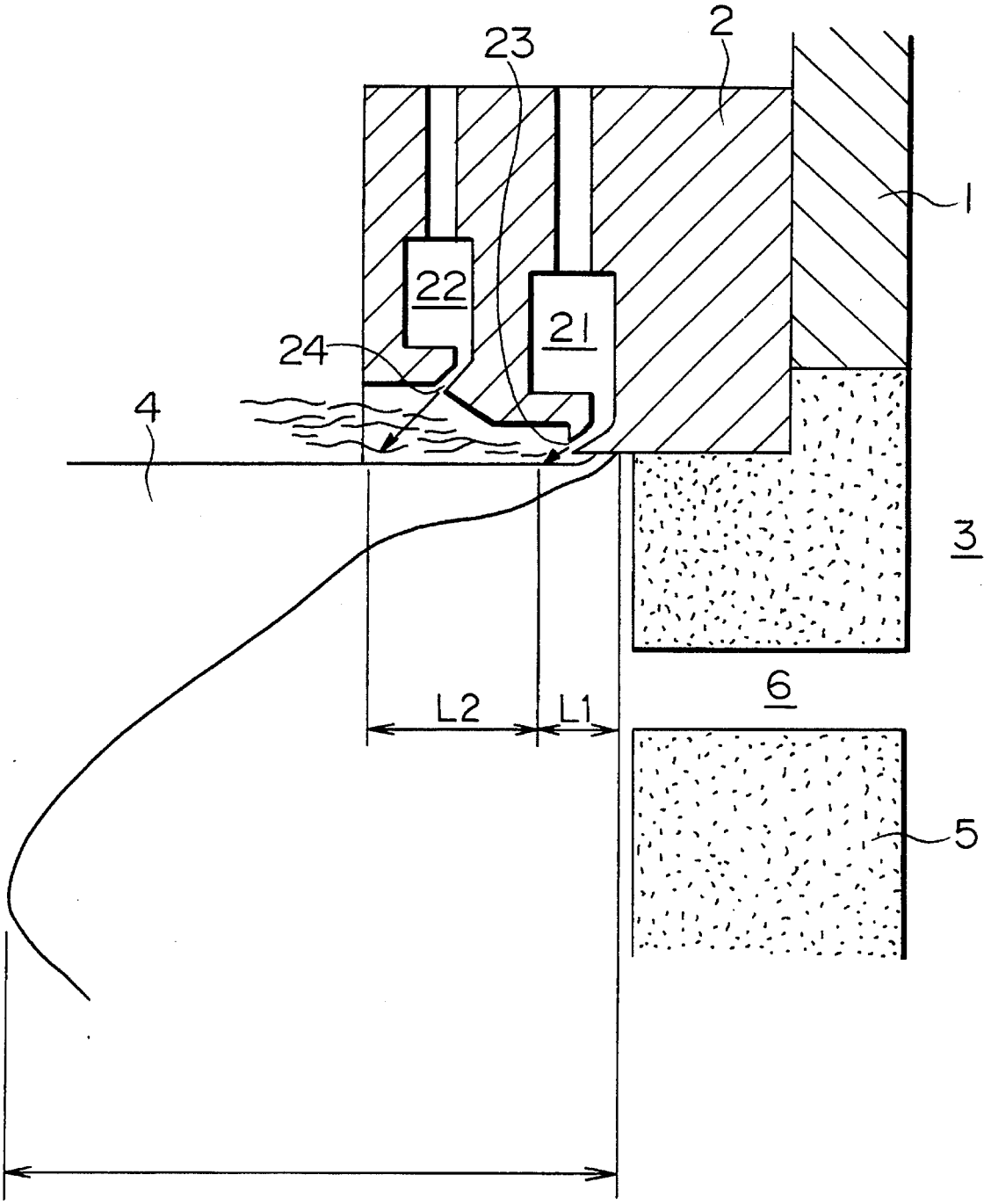
FIG. 3 is a partial enlarged view of FIG. 1.
Figure 4:
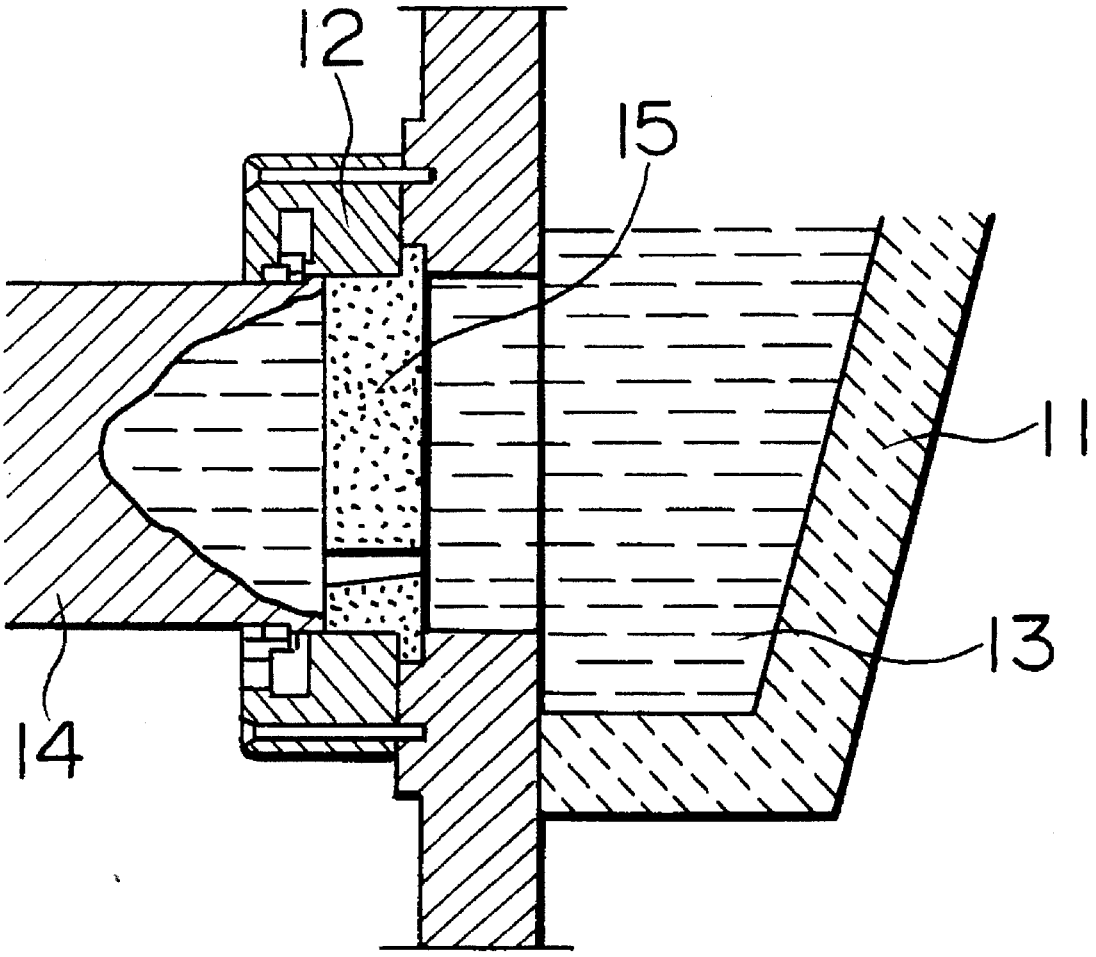
FIG. 4 is a longitudinal sectional view of the main part which shows a cooling state in the conventional continuous casting process.

A preferred embodiment of this invention will be illustrated with reference to the accompanying drawings. This invention is not only usable in a horizontal casting as illustrated herein, but also may be used in a vertical casting. FIG. 1 is a longitudinal sectional view of a cooling portion in the casting, which is a typical embodiment of this invention. FIG. 2 is a longitudinal sectional view for showing the cooling portion at the start of the casting, and FIG. 3 is a partially enlarged sectional view of the cooling portion.

In these drawings, a tundish, a molten metal, an orifice plate, an orifice, a starting block, and a starting pin are respectively indicated by reference numerals 1, 3, 5, 6, 7, and 8. These members have essentially the same structure as the conventional casting members.

A cooling mold which is disclosed as an essential part of this invention is indicated by reference numeral 2. First and second ring shaped water cooling jackets 21, 22 are formed in front and rear positions with a predetermined space inbetween on the same axis of the cooling mold. A part of each of the water cooling jackets 21, 22 communicates with an external cooling water supply pipe. The first and second water cooling jackets 21, 22 are respectively opened on the inner surface of the cooling mold 2 to form individual jet mouths 23, 24. The jet mouth 23 of the first water cooling jacket 21 which is arranged near the tundish 1 is formed with a slit opening on the whole inner circumferential surface of the mold 2. The jet mouth 24 of the second water cooling jacket 22 which is arranged further from the tundish 1 than the first water cooling jacket 21 is formed with a grooved or holed opening on the whole inner circumferential surface of the mold 2.

A set position of the jet mouth 23 of the first water cooling jacket 21 is determined by the position in which the cooling water jetted from the jet mouth 23 contacts with the ingot 4. In the case of an ingot with a diameter of 6 to 9 inches, the jet mouth 23 should be set at a position such that the contact point is favorably disposed at a distance L1 which is between 15 to 40 mm from the meniscus.

A set position of the mouth 24 of the second water cooling jacket 22 is also determined by the distance L2 between the position where the primary cooling water contacts with the ingot 4 and the other position where the secondary cooling water contacts with the ingot 4. In the case of an ingot with a diameter of 6 to 9 inches, the distance L2 is favorable at a distance between 20 to 45 mm.

Moreover, commonly in the first and second water cooling jackets 21 and 22, the cooling water impinging angle against the ingot surface exerts a large influence upon the cooling efficiency. According to this invention, the angle formed between the impinging cooling water and the ingot surface is preferably set at an angle between 15 to 30 degrees in the primary cooling and at an angle between 30 to 60 degrees in the secondary cooling.

In the continuous casting with the above-mentioned structure, a starting block 7 is inserted into the cooling mold 2 of this invention at the start of casting as shown in FIG. 2. A starting pin 8 secured to the tip of the starting block 7 is contacted with an end face of an orifice plate 5. In this state, a molten metal is introduced through orifices 6 of the orifice plate 5 into the mold 2, and when the starting block 7 is withdrawn at a predetermined rate from the mold 2, the casting is started.

A plurality of orifices 6 are formed in the orifice plate 5. The molten metal 3 in the tundish 1 is introduced through the orifices 6 into the cooling mold 2, and since the molten metal 3 is in contact with the inner surface of the mold 2, the surface of the molten metal 3 is cooled to produce a thin solidified shell. Then, the molten metal 3 is directly cooled with a primary cooling water which is jetted from the primary jet mouth 23 of the mold 2, so as to advance the solidification. Since a transition boiling zone and a film boiling zone are produced on the surface of the ingot 4 by the impingement of the primary cooling water, when a secondary cooling water impinges from the second jet mouth 24 of the cooling mold 2 upon the vapor film of these zones, the transition boiling zone and the film boiling zone are broken out of the impinging cooling water to provoke a nucleate boiling so as to produce a firmer solidified shell in the secondary direct cooling against the ingot surfaces.

This invention is illustrated in the embodied example wherein an ingot of an aluminum alloy based on Japanese Industrial Standard 6063 is cast by use of a casting apparatus shown in FIG. 1 in the following casting conditions.

(1) The distance L1 between the meniscus and the contact point of the primary jet of cooling water is varied in the following casting conditions to cast the ingot. The results are shown in Table 1.

a. Kinds of alloy: JIS 6063 aluminum alloy b. Diameter of ingot: 7 inches (178 mm)

c. Casting rate 350 mm/min d. Casting temperature: 690° C.

e. Amount of primary jet of cooling water: 85 l/min

TABLE 1

| L1 | Breakout | Bleeding out; Segregation |
|---|---|---|
| 10 mm | present | — |
| 15 mm | not present | slightly |
| 25 mm | not present | slightly |
| 35 mm | not present | slightly |
| 40 mm | not present | a little |
| 45 mm | not present | much |

(2) The distance L2 between contact points of the primary and secondary impinging cooling water on the ingot is varied in the following casting conditions to cast the ingot. The results are shown in Table 2.

a. Kind of alloy: JIS 6063 aluminum alloy b. Diameter of ingot: 7 inches c. Casting rate: 350 mm/min d. Casting temperature: 690° C.

e. Amount of primary jet of cooling water: 85 l/min f. Amount of secondary jet of cooling water: 45 l/min g. Distance between meniscus of molten metal and contact point of primary impinging cooling water: 25 mm

TABLE 2

| L2 | Nucleate boiling effects | Casting cracks |
|---|---|---|
| 15 mm | small | a little |
| 20 mm | middle | not present |
| 30 mm | large | not present |
| 40 mm | large | not present |
| 45 mm | large | a little |
| 50 mm | middle | a little |

As stated hereinabove, in accordance with this invention, advantageous results may be obtained as follows:

1. Since a firm solidified shell is produced within a short distance from the meniscus of the molten metal by proper cooling, it is possible to provide a stable high rate casting so as to improve production and yield considerably.

2. Since it is possible to provide effective cooling, the amount of cooling water is considerably reduced allowing miniaturization of the cooling water pumping equipment and energy savings.

3. Since a powerful cooling is carried out at a short distance from the meniscus, it is possible to prevent surface defects such as bleeding out and the like.

4. Since the powerful cooling is carried out in two steps, only a short unsolidified portion is produced in the ingot which prevents internal defects such as casting cracks and the like.

5. Since an internal composition of the ingot becomes fine with the powerful cooling, it is intended to shorten a homogenizing process time, to promote an easy extrusion, and to improve strength of an extruding material.

It is to be understood that the invention is not limited to the features and embodiments hereinabove specifically set forth, but may be carried out in other ways without departure from the spirit and scope of the present invention.

We claim:

1. A cooling method for cooling an ingot which is continuously withdrawn and cast from a mold by cooling a molten metal in said mold in a continuous casting process, said cooling method comprising:

cooling said ingot by impinging said ingot with a primary jet of cooling water from said mold at a short distance from a meniscus of said molten metal to establish a transition boiling zone and a film boiling zone on the surface of said ingot, said molten metal being cooled in contact with the inner surface of said mold before being cooled by said primary jet of cooling water; and cooling said ingot by impinging the ingot with a secondary jet of cooling water from said mold onto initial zones of said transition boiling zone and said film boiling zone to break-out a vapor film generated in said initial zones so as to provoke a nucleate boiling and thereby to produce a firmer solidified shell in said ingot without causing casting cracks, whereby said solidifying ingot is properly and effectively cooled to provide stable high rate casting and high quality ingot, wherein said primary jet of cooling water impinges against an ingot surface at an angle between fifteen and thirty degrees, and said secondary jet of cooling water impinges against said ingot surface at an angle between thirty and sixty degrees.

2. The cooling method according to claim 1, wherein said ingot has a diameter between six inches and nine inches, and said primary jet of cooling water impinges from said mold onto said ingot at a contact point set at a distance between fifteen and forty millimeters from the meniscus corresponding to a starting point of development of a solidifying shell.

3. The cooling method according to claim 1, wherein said ingot has a diameter between six and nine inches, and said secondary jet of cooling water impinges on said transition boiling zone and said film boiling zone at another ingot contact point set at a distance between twenty and forty-five millimeters from said contact point of the primary jet of cooling water from said mold.

4. A cooling casting mold for a continuous casting process in which an ingot is continuously withdrawn and cast from said mold while cooling a molten metal in said mold, said cooling casting mold comprising:

a first water cooling jacket provided inside of said mold having a primary cooling water jetting mouth situated at a first predetermined distance in the withdrawing direction of the ingot wherein the water jetting mouth is set at an angle between fifteen degrees and thirty degrees relative to a surface of said ingot; and a second water cooling jacket provided inside of said mold having a secondary cooling water jetting mouth situated at a second predetermined distance in the withdrawing direction of the ingot wherein the second distance is greater than the first distance and further wherein the secondary cooling water jetting mouth is set at an angle between thirty degrees and sixty degrees relative to the surface of the ingot.

5. The cooling casting mold according to claim 4, wherein said primary cooling water jetting mouth provides a slit shape on the whole inner circumferential surface thereof, and said secondary cooling water jetting mouth provides a grooved or holed shape.

* * * * *

UNITED STATES PATENT AND TRADEMARK OFFICE

CERTIFICATE OF CORRECTION

PATENT NO. : 5,452,756

DATED : September 26, 1995

INVENTOR(S) : Norio Ohatake, Makoto Arase and Yoshitaka Nagai

It is certified that error appears in the above-indentified patent and that said Letters Patent is hereby corrected as shown below:

On the title page, item [54], and in column 1, line 1, the title should read: --COOLING METHOD OF CONTINUOUS CASTING--.

Signed and Sealed this

Twenty-seventh Day of February, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,452,756

DATED : Sep. 26, 1995

INVENTOR(S) : Ohatake et al.

It is certified that error appears in the above-indentified patent and that said Letters Patent is hereby corrected as shown below:

On the Cover Page:

Item: [30] Foreign Application Priority Data

DELETE "Feb. 27, 1991 [EP] European Pat. Off.....91102931"

Signed and Sealed this

Twenty-third Day of April, 1996

Bruce Lehman

*Attest:*

BRUCE LEHMAN

*Attesting Officer*

*Commissioner of Patents and Trademarks*